US006446804B1

(12) United States Patent
Lehtineva

(10) Patent No.: US 6,446,804 B1
(45) Date of Patent: Sep. 10, 2002

(54) ROLL PACKAGE AND MANUFACTURING METHOD

(75) Inventor: Juha I. Lehtineva, Seinäjoki (FI)

(73) Assignee: Pasmel Oy, Kauhajuki (FI)

( * ) Notice: Subject to any disclaimer, the term of this patent is extended or adjusted under 35 U.S.C. 154(b) by 0 days.

(21) Appl. No.: 09/583,394

(22) Filed: May 31, 2000

(51) Int. Cl.[7] ..... B65B 11/00; B65D 85/671

(52) U.S. Cl. ..... 206/394; 53/449; 53/461; 206/410

(58) Field of Search ..... 53/399, 211, 587, 53/588, 449, 461, 463, 465; 206/389, 391, 394, 410; 242/160.1, 160.2, 160.4

(56) References Cited

U.S. PATENT DOCUMENTS

| | | | | | |
|---|---|---|---|---|---|
| 1,091,139 | A | * | 3/1914 | Jagenberg | 206/410 |
| 2,250,875 | A | * | 7/1941 | McConnell | 206/410 |
| 4,281,500 | A | * | 8/1981 | Mueller et al. | 53/211 |
| 4,736,567 | A | * | 4/1988 | Pienta | 53/137 |
| 4,882,892 | A | * | 11/1989 | Pienta | 53/587 |
| 4,936,459 | A | * | 6/1990 | Mushinski et al. | 206/389 |
| 5,054,263 | A | * | 10/1991 | Mäki-Rahkola et al. | 53/399 |
| 5,092,109 | A | * | 3/1992 | Maki-Rahkola et al. | 53/587 |
| 5,131,209 | A | * | 7/1992 | Schreiber et al. | 53/399 |
| 5,850,918 | A | * | 12/1998 | Pienta | 206/410 |
| 5,873,464 | A | * | 2/1999 | Haley | 206/398 |
| 5,890,591 | A | * | 4/1999 | Pienta | 206/410 |
| 6,186,326 | B1 | * | 2/2001 | Pienta et al. | 206/410 |

FOREIGN PATENT DOCUMENTS

| | | |
|---|---|---|
| DE | 41 21 573 A1 | 1/1993 |
| DE | 41 37 448 A1 | 5/1993 |
| EP | 0 105 039 A2 | 4/1984 |
| WO | WO 92/17371 | 10/1992 |
| WO | WO 99/15409 | 4/1999 |

* cited by examiner

*Primary Examiner*—Jim Foster
(74) *Attorney, Agent, or Firm*—Connolly Bove Lodge & Hutz, LLP

(57) ABSTRACT

The invention relates to a roll package for a roll having a longitudinal roll axis, a pair of spaced roll ends and an outer roll surface extending between the roll ends and radially spaced from said longitudinal roll axis. The roll package comprises a first layer positioned over said outer roll surface and wrapped on the roll in a direction substantially perpendicular to said longitudinal roll axis. The first layer is a cushioned protective layer. A separate second layer is positioned over said first layer and extends throughout the length of said roll. The invention also relates to a method of making a roll package for a roll having a longitudinal roll axis. In one embodiment, a roll package comprises two or more said rolls having a common longitudinal axis and situated against each other, a pair of opposing ends. Each roll has at least said first layer and said second layer. Each roll comprises a separate layer positioned over said layers and extending throughout the length of said set of rolls and over said opposing ends in a direction substantially parallel to said common longitudinal axis.

34 Claims, 6 Drawing Sheets

ROLL PACKAGE AND MANUFACTURING METHOD

BACKGROUND OF THE INVENTION

It is known that pieces, such as cylindrical paper rolls, are wrapped by using wrapping apparatuses which perform the wrapping by means of a wrapping film, preferably a transparent stretch film. These wrapping apparatuses normally use a thin plastic film which is guided around the piece while the piece is rotated around its central line. It is also known to transfer the wrapping apparatus in the direction of the central line to wrap the whole envelope surface of the piece with several layers of the wrapping film. As to the techniques involved in cutting, sealing and feeding of the film, reference is made to U.S. Pat. No. 5,092,109. During the wrapping, the wrapping film is also stretched in a controlled way, as presented in U.S. Pat. No. 5,054,263.

Forming roll packages comprise several film layers and protective layers which protect the roll material, roll ends, and particularly the roll edges. Packages of prior art are presented in U.S. Pat. No. 5,890,591, in which the first film layer is a film wrapped in the axial direction. The second layer is padding, and the third layer is a film wrapped in the spiral and radial direction. According to U.S. Pat. No. 5,850,918, the padding placed around the roll end and on the roll edge is foam plastic or bubble pack plastic. One wrapping apparatus for radial wrapping is presented in U.S. Pat. No. 4,736,567, whereby films can be fed on the roll in an interleaved manner. One roll package for a sensitive material is presented in U.S. Pat. No. 5,873,464. The package comprises a bubble pack layer and a film layer extending over the ends of the roll in an interleaved manner. Protective pieces are placed at the ends of the roll. One apparatus for axial wrapping is presented in U.S. Pat. No. 4,281,500. The rotation is performed by means of rolls fitted in a rotating table.

During transportation and manipulation, rolls are susceptible to mechanical damage, wherein particularly their edges must be well protected e.g. with padding. The roll can also be damaged during the manufacture by machine transfers and manipulation between separate wrapping apparatuses, and by the film itself, stretched around the roll. Thus, the layers protecting the roll should be fitted in such a way that they protect the roll efficiently at all stages. By placement of the layers, a tight package should be achieved, to prevent the effects of soil and moisture.

In the order of wrapping the layers of the roll, one must take into account the apparatuses available for wrapping, which are often simple automated devices and are often separate, as well as their phasing, wherein there should be as few transfers of the roll as possible. Separate wrapping devices can comprise the axial wrapping of a single layer, the radial wrapping of a single layer, or these wrappings combined.

SUMMARY OF THE INVENTION

The present invention is directed to an improved roll package and a method of manufacturing an improved roll package. In one embodiment of the invention the roll package comprises three layers. The layers are placed crosswise on top of each other. In another particularly advantageous embodiment of the invention, the improved roll package comprises a set of rolls which are first wrapped separately and then wrapped together for forming one roll package. Thus, in one embodiment of the invention the roll package comprises four layers, wherein the fourth layer binds the separate rolls together. Also in this case the layers are placed crosswise on top of each other.

The roll package comprises a first layer which is a protective layer and which is wrapped in the radial direction. In one embodiment, the layer is a foam layer, preferably foam plastic, or a bubble pack layer. The bubble pack layer is for example of a material in which small air cushions are closed between two plastic layers. If necessary, the protective layer is bent over the roll edge to cover the roll end at least partly. In one embodiment, the protective layer comprises separate portions which are placed on the roll mantle by the side of the ends. The second layer is a plastic film which is wrapped preferably in the axial or in the radial direction. It keeps the first layer in its position and is placed tightly against the roll. The axial wrapping protects the roll uniformly, also the end of the roll. It adheres effectively to the material of the second layer, forming a very tight roll package. The third layer is wrapped on the roll mantle, but in one embodiment, it is also extends over the roll edge in a tightening manner, covering the end of the roll at least partly. Alternatively the second layer is a plastic film layer wrapped axially or a craft paper for forming a durable and opaque layer, which forms the outermost surface of the roll.

The improved roll package comprising a set of wrapped rolls having at least two layers is particularly adaptable for forming multi-packages. The rolls can be transported in one larger package. Single rolls can be separated from the package, but in spite of this, they are each protected with at least two layers from damage. The package thus comprises a separate layer which is a plastic film wrapped axially over all the rolls and the layers. Thanks to the tight plastic film, adjacent rolls are tightly supported to each other by means of axial wrapping. The movement of the rolls against each other is made more effective by rotating the rolls around their common longitudinal axis during the wrapping. The ends of the rolls are against each other.

The roll ends are protected by axially wrapped second layer or by axially wrapped third layer. Alternatively, the roll ends are protected by radially wrapped second layer and two circular end covers. The end covers are applied on said roll ends covering them entirely. Alternatively, the roll ends are protected by radially wrapped second layer, wherein the second layer is a craft paper, and circular end covers. Devices for applying the end covers on the roll ends are known as such.

If the width of the material of the first layer is smaller than the length of the roll, it can be fitted around the roll in a spiral manner. In one embodiment, the first layer comprises several lengths fitted next to each other which are attached and cut and which extend at least one circumference around the roll mantle. The material is supplied as a band from one or more material rolls of the wrapping apparatus, wherein the bands can also be placed in a partly overlapping manner.

The apparatus required to apply the method for forming a roll package comprises a first radial wrapping device for said first layer, an axial wrapping device, and a second radial wrapping device. In connection with these devices, the roll is rotated in its position by rollers around a horizontal longitudinal axis. The second radial wrapping device and the axial wrapping device can be arranged in connection with the same rotating device, wherein the roll does not need to be moved. Between the first and the second device, the roll is moved on top of a controlled movable carriage which lifts up the roll and descends it on top of the rollers. When making multi-packages, single packages are moved from the second device by a carriage and first collected into an intermediary station from which they are returned together for axial wrapping. Said axial wrapping device is also used for the wrapping of said separate layer.

DESCRIPTION OF THE PREFERRED EMBODIMENTS

Figure 1:
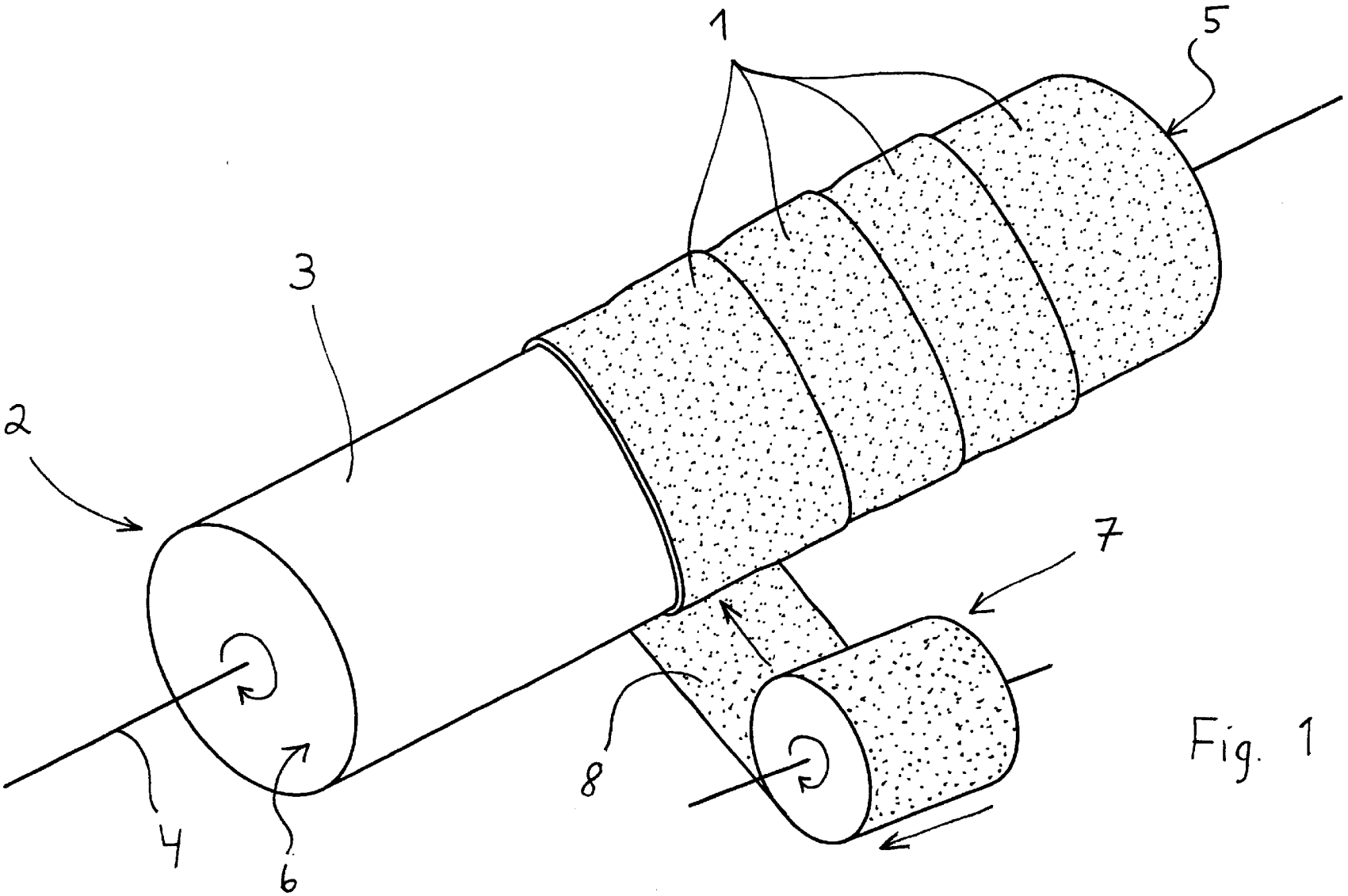
FIG. 1 is a simplified perspective view showing the roll package while the first layer is being applied using continuous band.

FIG. 1 illustrates radial wrapping of a first layer 1 of a roll package on the external mantle 3 of a roll 2. The roll 2 has a longitudinal roll axis 4, a pair of spaced roll ends 5, 6 and an outer roll surface 3 extending between the roll ends 5, 6 and being radially spaced from the longitudinal roll axis 4. The first layer 1 is positioned over the outer roll surface 3 an d wrapped on the roll in a direction substantially perpendicular to the longitudinal roll axis 4. The roll 2 is simultaneously rotated in its position around its axis 4 by means of devices known as such. The width of a band 8 to be supplied from a roll 7 is smaller than the length of the roll 2, wherein a carriage, known as such, having the band roll 7 is moved in the direction of the axis 4 during the wrapping. The first 1 layer 1 is wrapped with the continuous material band 8 in a spiral manner. In the different figures, the length of the roll 2 is varied to better illustrate the wrapping.

Figure 2:
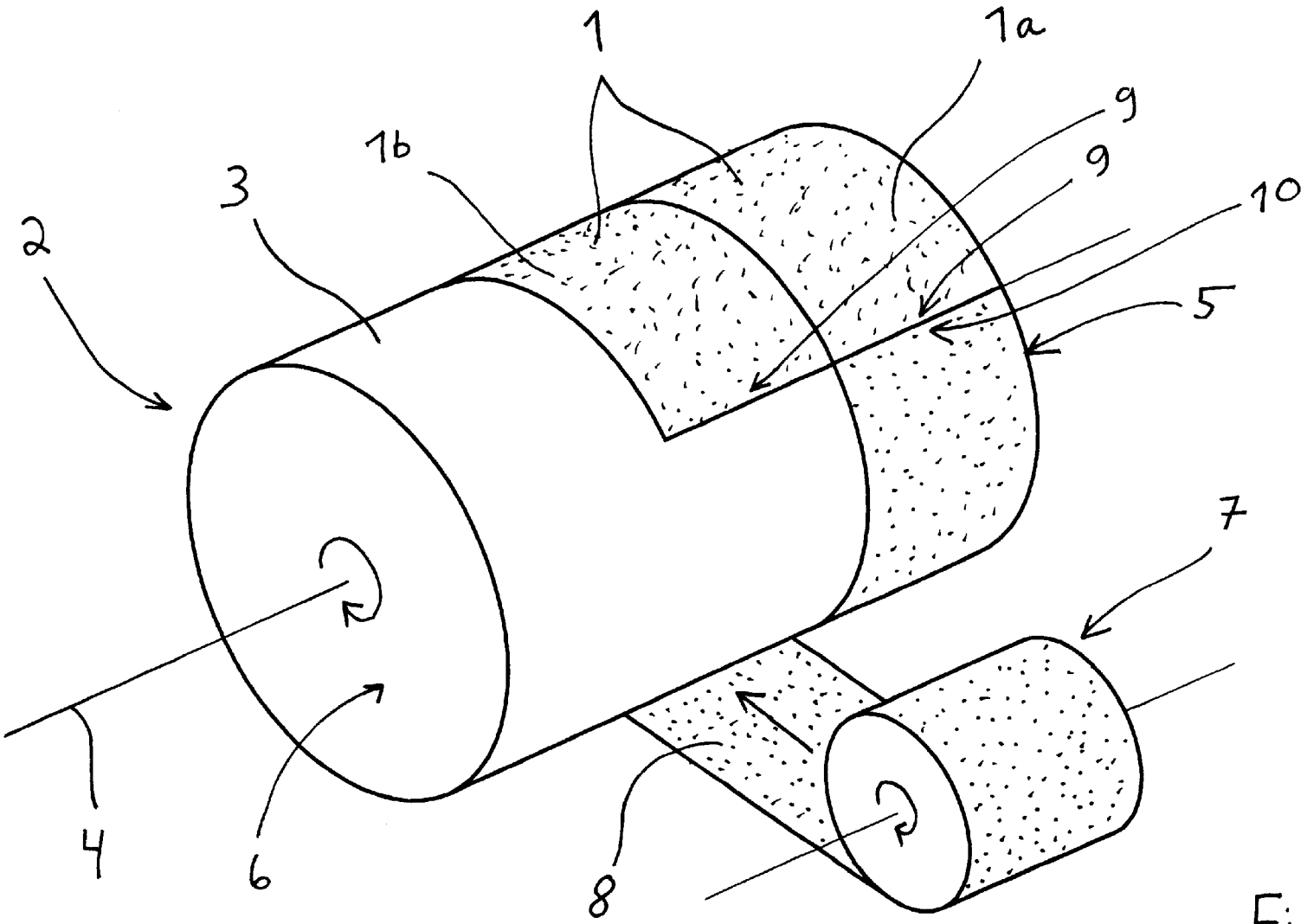
FIG. 2 is a simplified perspective view showing the roll package while the first layer is being applied using lengths of band material.

Another embodiment of the first layer is shown in FIG. 2, wherein the layer 1 consists of two or more material bands 1*a*, 1*b* with a determined length, fitted adjacent to each other and extending substantially one revolution around the mantle 3. The leading end 9 of the band 8 to be supplied from the roll 7 is adhered onto the mantle 3 and cut at the terminal end 10 which is adhered onto the mantle 3 or on top of the leading end 9. The adhesive is supplied onto the band 8 and, at the same point, there is normally also a cutter. Alternatively, the adhesion is made by taping for example manually. The material roll 7 remains in its position during the rotation of the roll 2 and the wrapping of the band 1*a* and is moved to a new position for wrapping the band 1*b*. The first layer 1 can thus be made thinner and more uniform than the layer 1 of FIG. 1. It is thus possible to wrap thicker or more rigid protective materials without increasing the diameter of the roll package excessively. In the wrapping, wrapping devices known as such are applied, as well as their cutting and gluing means which are arranged to operate in the above-described manner. The ends of the plastic band can be fixed in a way known as such by heating, for example by using a hot wire. The wrapping apparatus can, in a way known per se, comprise two carriages, a band roll 7 being placed in each carriage. Wrapping can thus be started at both roll ends 5, 6 simultaneously, to accelerate the wrapping.

Figure 3:
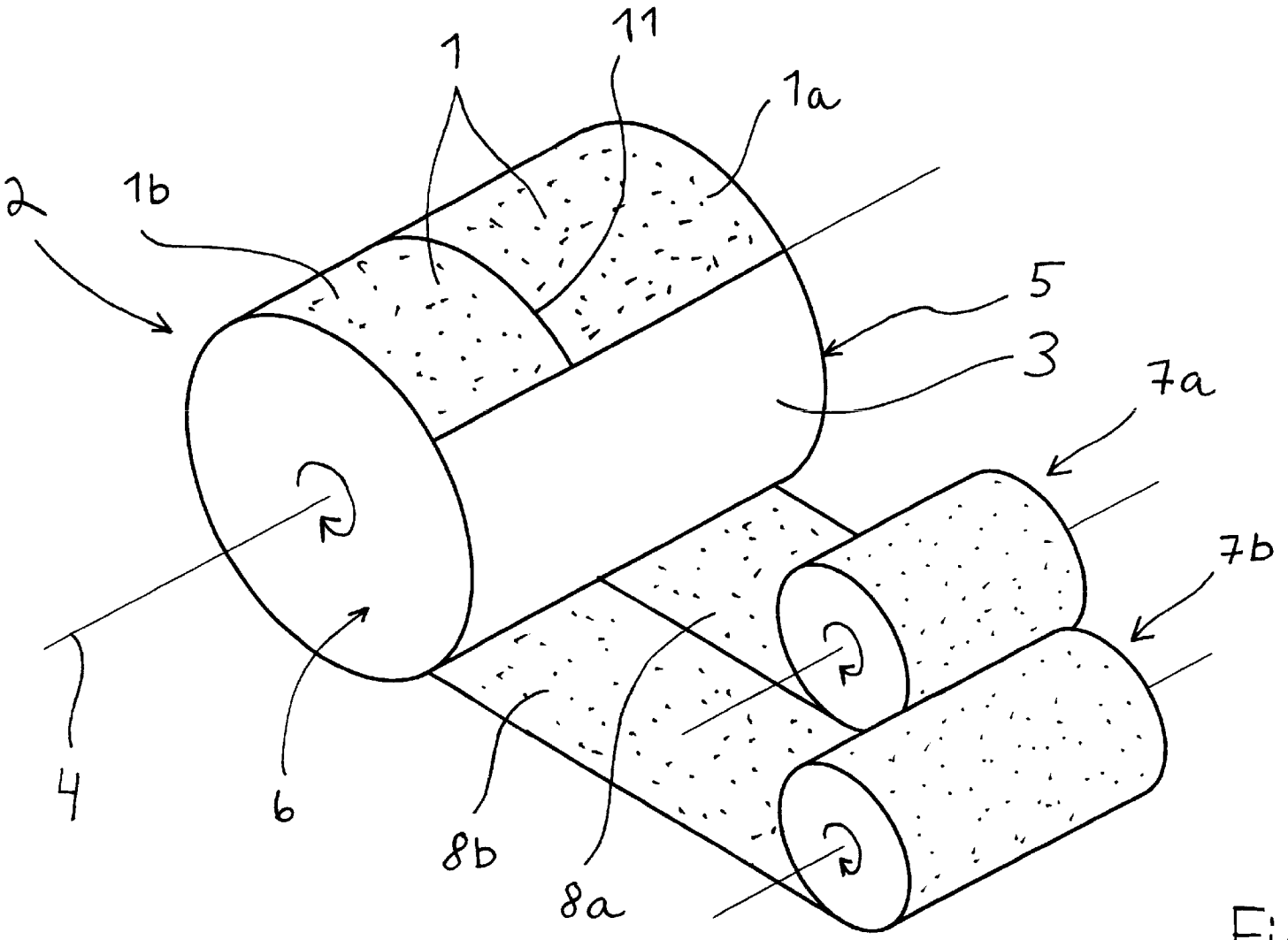
FIG. 3 is a simplified perspective view showing the roll package while the first layer is being applied using two lengths of band situated partly over each other.

Yet another embodiment of the first layer is shown in FIG. 3, wherein the material 1*a* and 1*b* are placed in a partly interleaved manner, forming a tight roll package and a closed seam 11. The material band 8*a*, 8*b* is supplied from two different band rolls 7*a*, 7*b* which are placed in the same carriage to accelerate the wrapping. By means of the interleaving, the width of the layer 1 can be matched to the length of the roll 2. In the wrapping, the above-described cutting and glueing techniques are applied. The band rolls 7*a* and 7*b* can preferably be transferred also in relation to each other. When the width of the material band 8*a* is the same as or greater than the length of the roll 2, one material band 1 a is sufficient for the first layer 1.

FIG. 1 shows axial wrapping of a second layer 12 of the roll package on top of the first layer 1 according to FIG. 1, 2 or 3. The separate second layer 12 is positioned over the first layer 1, and it extends throughout the length of roll 2 and over the spaced roll ends 5, 6 in a direction substantially parallel to the longitudinal roll axis 4. The roll 2 is simultaneously rotated in its position around the axis 4 by means of devices known as such. In the wrapping apparatus, known as such, the carriage in which the material roll 13 is placed is arranged to rotate around the roll 2 at a substantially constant height along a circular path. The material of the layer 12 is discharged as a band 14 from the roll 13.

Figure 5:
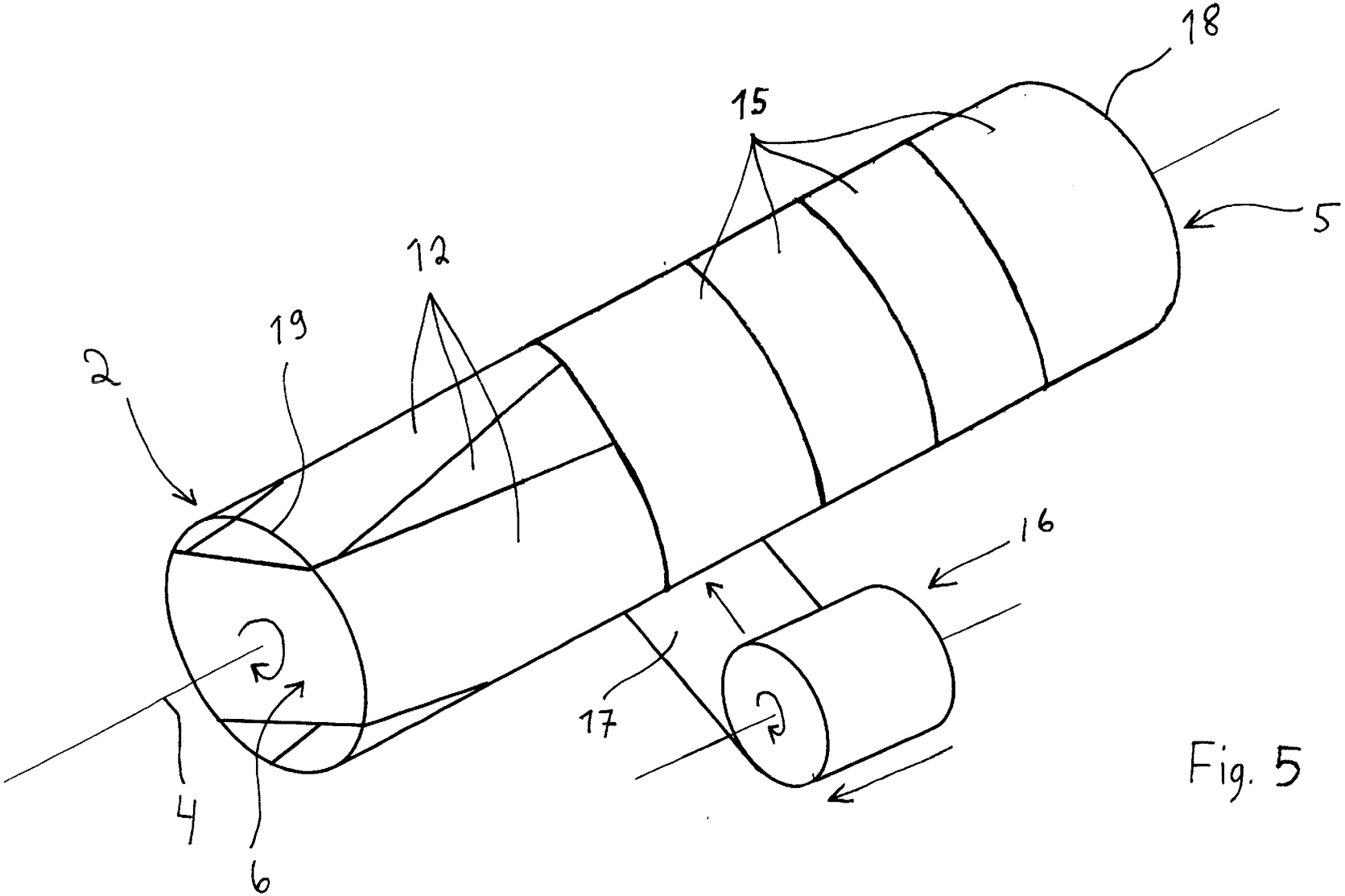
FIG. 5 is a simplified perspective view showing the roll package while the radially wrapped third layer is being applied.

FIG. 5 shows radial wrapping of a third layer 15 of the roll package by using a continuous material band 17 supplied in a spiral manner from a roll 16. The operation corresponds to wrapping according to FIG. 1. The roll 2 is simultaneously rotated in its position around the axis 4 by means of devices known as such. The separate third layer 15 is positioned over the second layer 12, and it extends throughout the length of the roll 2 in a direction substantially perpendicular to said longitudinal roll axis 4. As the width of the band 17 is greater than the length of the roll 2, the stretched plastic film material extends also over the edges 18, 19 of the roll 2 and onto the roll edges 5, 6, wherein a third layer 15 protects and supports the edges 18, 19 and partly also the ends 5, 6. The third layer 15 comprises several band layers. As also the material of the first layer 1 extends across the edge 15, 16 and inwards, the band materials of the third layer 15 press it also against the end 5, 6.

Figure 4:
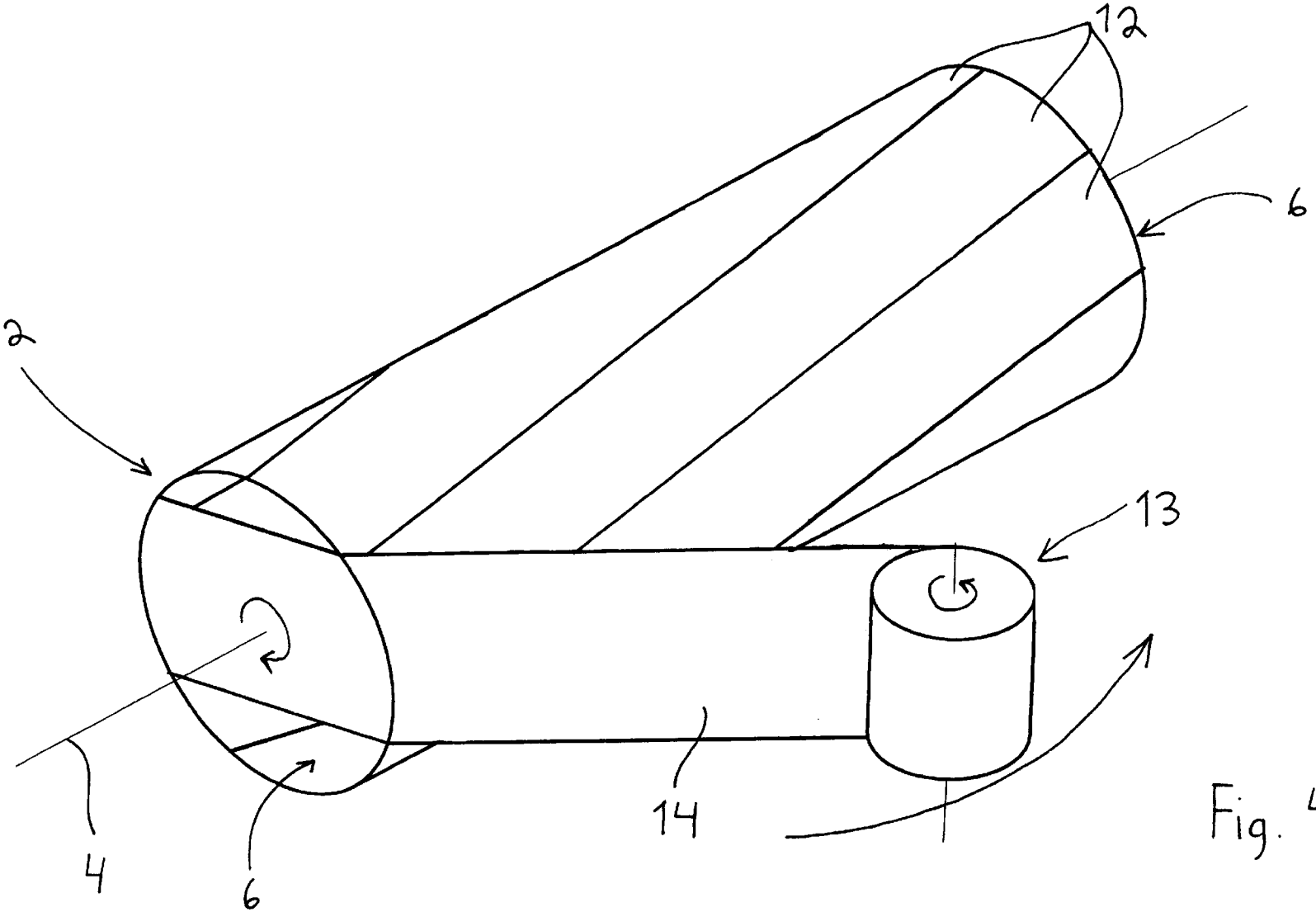
FIG. 4 is a simplified perspective view showing the roll package while the axially wrapped second layer is being applied.
Figure 6:
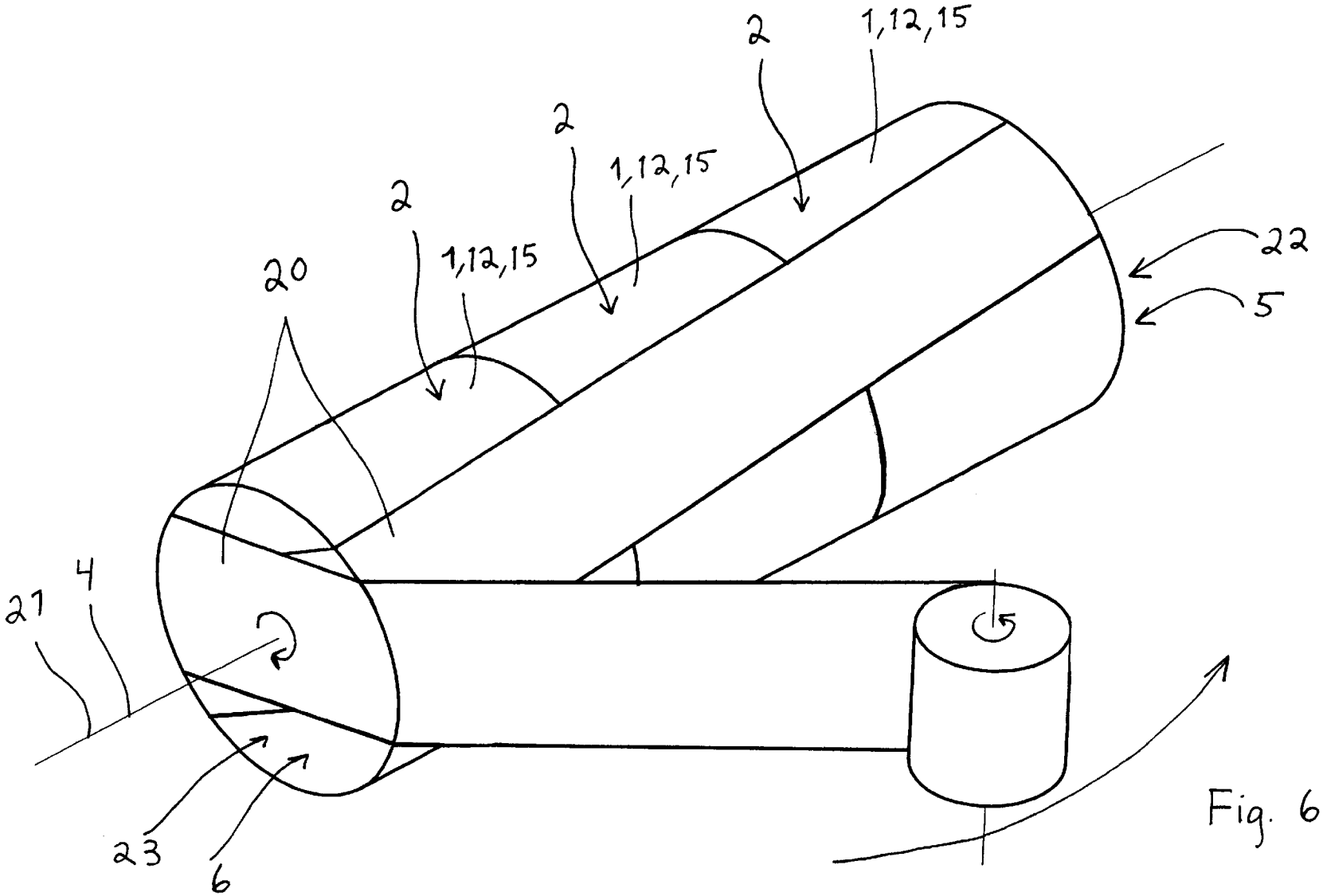
FIG. 6 is a simplified perspective view showing the roll package for a set of rolls while the separate layer is being applied.

FIG. 6 shows axial wrapping of a separate, fourth layer 20 of the roll package. The roll package comprises the three rolls 2 having a common longitudinal axis 21 and situated against each other, a pair of opposing ends 22 and 23. The axis 21 is convergent with the axes 4 of the rolls 2 which each have a first layer 1, a second layer 12 and a third layer 18 formed in the manner described in FIGS. 1 to 5. The roll package comprises a separate fourth layer 20 which is positioned over the third layers 15 and extended throughout the length of said set of rolls 2 and over said opposing ends 22, 23 in a direction substantially parallel to said common longitudinal axis 21. The separate fourth layer 20 forms the outermost surface of the multi-roll package. The operation corresponds to wrapping according to FIG. 4. Rolls 2 arranged adjacent to each other are brought onto the same rotating rollers or a rotating band of prior art, and they are rotated at the same speed around the common axis 21. In axial wrapping, the separate fourth layer 20 stretched around the rolls 2 pushes the rolls 2 against each other, producing a tight and uniform roll package. The final result resembles the layer shown in FIG. 4. The ends 5, 6 of the rolls 2 are tightened and supported to each other in a more efficient manner than in radial wrapping. In radial wrapping, the layer material tends to penetrate in between the ends of adjacent rolls 2, which causes problems.

Numerous modifications may be made to the preferred embodiments of the roll package and method of making the roll package described above without departing from the scope of the present invention or from the following claims.

What is claimed is:

1. A roll package for a roll, said roll having a longitudinal roll axis, a pair of spaced roll ends and an outer roll surface extending between the roll ends and radially spaced from said longitudinal roll axis, said roll package comprising:

a first layer positioned over said outer roll surface and wrapped on the roll in a direction substantially perpendicular to said longitudinal roll axis, said first layer being a cushioned protective layer, and a separate second layer positioned over said first layer and extending throughout the length of said roll; said roll package further comprising:

a plurality of said rolls abutting about a common longitudinal axis and having a pair of opposing ends, said rolls each having at least said first layer and said second layer; and a surface layer positioned over said first and second layers, said surface layer extending over the length of said plurality of rolls and over said opposing ends in a direction substantially parallel to said common longitudinal axis.

2. A roll package according to claim 1, comprising a separate third layer positioned over said second layer.

3. A roll package according to claim 1, comprising circular roll end covers for protecting said roll ends.

4. A roll package according to claim 1, wherein said second layer is extended throughout the length of said roll and over said spaced roll ends in a direction substantially parallel to said longitudinal roll axis.

5. A roll package according to claim 1, wherein said second layer is extended throughout the length of said roll in a direction substantially perpendicular to said longitudinal roll axis.

6. A roll package according to claim 2, wherein said third layer is extended throughout the length of the said roll in a direction substantially perpendicular to said longitudinal roll axis.

7. A roll package according to claim 2, wherein said third layer is extended throughout the length of the said roll and over said spaced roll ends in a direction substantially parallel to said longitudinal roll axis.

8. A roll package according to claim 2, wherein said third layer is a plastic film or a craft paper.

9. A roll package according to claim 1, wherein said second layer is a plastic film or a craft paper.

10. A roll package according to claim 1, wherein said first layer is a foam or a bubble pack.

11. A roll package according to claim 1, wherein said first layer extends throughout the length of said roll.

12. A roll package according to claim 1, wherein said first layer includes separate portions applied on said outer roll surface adjacent to said roll ends.

13. A roll package according to claim 1, wherein a portion of said first layer extends inwardly over a portion of said roll end.

14. A roll package according to claim 2, wherein a portion of said third layer extends inwardly over a portion of said roll end.

15. A roll package according to claim 1, wherein said surface layer is a plastic film.

16. A roll package according to claim 1, wherein said first layer includes separate lengths of cushioned protective applied on said outer roll surface, positioned adjacent to each other and extending throughout the circumference of said roll.

17. A roll package according to claim 1, for a roll, said roll having a longitudinal roll axis, a pair of spaced roll ends and an outer roll surface extending between the roll ends and radially-spaced from said longitudinal roll axis, said roll package comprising:

a first cushioning layer positioned over said outer roll surface and wrapped on the roll in a direction substantially perpendicular to said longitudinal roll axis, wherein said first layer comprises a plurality of separate lengths of cushioned protective applied on said outer roll surface, extending throughout the circumference of said roll and said adjacent lengths positioned partly over each other; and a separate second layer positioned over said first layer and extending throughout the length of said roll, said roll package further comprising:

a plurality of said rolls abutting about a common longitudinal axis and having a pair of opposing ends, said rolls each having at least said first layer and said second layer; and a surface layer positioned over said first and second layers, said surface layer extending over the length of said plurality of rolls and over said opposing ends in a direction substantially parallel to said common longitudinal axis.

18. A roll package according to claim 1, wherein said first layer is positioned over said entire outer roll surface.

19. A roll package according to claim 1, wherein said second layer is positioned axially over said first layer.

20. A method of making a roll package for a tandem pair of first and second rolls, said method comprising the steps of:

providing first and second rolls, wherein each said roll has a longitudinal roll axis, a pair of spaced roll ends and an outer roll surface extending between the roll ends and radially spaced from said longitudinal roll axis;

radially wrapping said outer roll surface of said first and second rolls with a first layer comprising cushioned protective material;

wrapping said first and second rolls with a second layer, wherein said second layer is applied on said first layer and wherein said second layer extends throughout the length of said first and second rolls;

abutting a first end of said first roll with a first end of said second roll about a common longitudinal axis forming a tandem roll having a pair of opposing ends; and axially wrapping said tandem roll with a surface layer, wherein said surface layer is applied over said first and second layers and over said opposing ends.

21. A method according to claim 20, including the step of wrapping said roll with the third layer wherein the third layer is applied on said second layer and extended throughout the length of said roll.

22. A method according to claim 20, including the step of applying circular roll end covers over said roll ends.

23. A method according to claim 20, wherein the first layer is wrapped in a separate radial wrapping station.

24. A method according to claim 20 of making a roll package for a roll, said roll having a longitudinal roll axis, a pair of spaced roll ends and an outer roll surface extending between the roll ends and radially spaced from said longitudinal roll axis, said method comprising the steps of:

radially wrapping said outer roll surface with a first layer comprising cushioned protective material;

wrapping said roll with a second layer wherein said second layer is applied on said first layer and extended throughout the length of said roll, and wrapping said roll with the third layer wherein the third layer is applied on said second layer and extended throughout the length of said roll, wherein said second and third layers are wrapped in a combined wrapping station for radial and axial wrapping.

25. A method according to claim 20, wherein the separate layer is wrapped in a combined wrapping station for radial and axial wrapping.

26. A method according to claim 20, wherein said third layer is a plastic film or a craft paper.

27. A method according to claim 20, wherein said second layer is a plastic film or a craft paper.

28. A method according to claim 20, wherein said first layer is a foam or a bubble pack.

29. A method according to claim 20, wherein said separate layer is a plastic film.

30. A method according to claim 20, wherein said first layer comprises separate lengths of cushioned protective positioned adjacent to each other and extended throughout the circumference of said roll as they are applied on said outer roll surface.

31. A method according to claim 20, of making a roll package for a roll, said roll having a longitudinal roll axis, a pair of spaced roll ends and an outer roll surface extending between said roll ends and radially spaced from said longitudinal roll axis, said method comprising the steps of:

radially wrapping said outer roll surface of said roll with a first layer wherein said first layer comprises a plurality of separate lengths of cushioned protective material extended throughout the circumference of said roll and wherein adjacent lengths positioned partly over each other as they are applied on said outer roll surface, and wrapping said roll with a second layer wherein said second layer is applied on said first layer and extended throughout the length of said roll.

32. A method according to claim 20, wherein the first layer is applied on said entire outer roll surface.

33. A method according to claim 20, wherein the first layer is radially wrapped on the roll in a direction substantially perpendicular to the longitudinal roll axis.

34. A method according to claim 20, wherein the second layer is applied axially on said first layer.

* * * * *